United States Patent [19]

Pavincic

[11] 4,273,060

[45] Jun. 16, 1981

[54] SAILING VESSEL

[76] Inventor: Ivan Pavincic, P.O. Box 4005, Florence, S.C. 29501

[21] Appl. No.: 134,087

[22] Filed: Mar. 26, 1980

[51] Int. Cl.[3] ..... B63H 9/06

[52] U.S. Cl. ..... 114/39; 9/1.3; 114/128; 114/102

[58] Field of Search ..... 114/39, 102, 103, 128; 9/1.3

[56] References Cited

U.S. PATENT DOCUMENTS

| | | | |
|---|---|---|---|
| 231,595 | 8/1880 | Mareglia | 114/149 |
| 421,008 | 2/1890 | Martin | 114/128 |
| 433,955 | 8/1890 | McPartland | 114/129 |
| 3,173,395 | 3/1965 | Laurent | 114/39 |
| 3,223,065 | 12/1965 | Wilson, Jr. | 114/39 |
| 3,304,899 | 2/1967 | Weatherly | 114/39 |
| 3,371,636 | 3/1968 | Sharp | 114/39 |
| 3,710,408 | 1/1973 | Sorenson | 9/1 |
| 3,985,090 | 10/1976 | Rineman | 114/39 |
| 4,054,100 | 10/1977 | Rineman | 114/39 |

FOREIGN PATENT DOCUMENTS

| | | | |
|---|---|---|---|
| 2751494 | 5/1979 | Fed. Rep. of Germany | 9/1.3 |

*Primary Examiner*—Trygve M. Blix
*Assistant Examiner*—John C. Paul
*Attorney, Agent, or Firm*—Bell, Seltzer, Park & Gibson

[57] ABSTRACT

The sailing vessel of the present invention includes a hull of omnidirectional construction, and a generally triangular sail which is supported along two side edges, with the third side edge unsupported and extending generally horizontally. The angular position of the sail with respect to the hull is fixed, and the heading of the boat is varied in order to orient the sail at the desired angle with respect to the wind. A pivotally mounted centerboard controls the direction or heading of the boat and control lines are provided for altering the shape of the sail to further control the direction and speed of sailing.

13 Claims, 11 Drawing Figures

SAILING VESSEL

FIELD OF THE INVENTION

This invention relates generally to a sailing vessel and more particularly to a sailing vessel with a sail supported and controlled in a novel manner to provide a unique system of sailing which is fundamentally different from the traditional system of sailing.

BACKGROUND AND SUMMARY OF THE INVENTION

In the conventional or traditional system of sailing, forward movement of the boat is governed by the heading of the boat and the trim of the sails with respect to the wind. In a conventional sailboat, the heading is always the direction in which the bow of the boat is pointing. The sail is mounted for pivotal movement with respect to the longitudinal axis of the boat and the position of the sail with respect to the longitudinal axis of the boat, i.e. the trim of the sail, is adjusted depending upon where the wind is coming from. For example, when the wind is behind the boat, the sail is let out all the way so as to make a 90° angle with respect to the longitudinal axis of the boat. When the wind is from the side, the sail is let out about half way, i.e. to form about a 45° angle with respect to the longitudinal axis of the boat. When sailing at an angle into the wind, the sail is close-hauled and is positioned almost along the longitudinal axis of the boat.

The sailing system of the present invention differs fundamentally from the above-described traditional sailing system. In the present invention, the position of the sail with respect to the hull remains the same, and the orientation of the hull with respect to the direction of movement of the boat is varied in order to orient the sail at the desired angle with respect to the wind. In order to accomplish this, the hull of the boat is of an omnidirectional construction so that there is no predetermined bow direction which always corresponds to the heading of the boat, and the boat is thus capable of sailing at various directions with respect to the hull.

The sailing vessel of the present invention is comprised of a hull means, which as noted above, is of an omnidirectional construction. A generally triangular sail is mounted to the hull means by a sail support which extends upwardly from the hull and cooperates with the sail for supporting two side edges of the sail along intersecting angularly upwardly extending axes, while leaving the third side edge of the sail unsupported and extending generally horizontally. The direction of sailing or heading with respect to the hull and the angular position of the sail with respect to the wind is controlled by a centerboard which is positioned beneath the hull and which is mounted for pivotal movement about a substantially vertical axis. On the upper side of the hull means there is a centerboard control which is positioned for operation by the sailor of the vessel for adjusting the pivotal direction of the centerboard relative to the hull. Additionally the shape of the sail may be altered, depending upon the direction of sailing, by suitable control means in the form of lines or ropes connected to the unsupported third side edge of the sail and adapted for pulling the sail laterally.

In one illustrated embodiment of the invention, the omnidirectional hull means is of a circular disclike construction. In another illustrated embodiment the sailboat is of a multihull construction comprising three individual buoyant hull members interconnected by a frame.

In one embodiment of the invention the sail is supported in its upright orientation by a pair of masts which extend angularly upwardly from the hull and are joined together at the top. In an alternate arrangement, there may be a single mast extending upwardly from the hull and the sail is supported by a pair of shrouds extending angularly between the hull and the upper end of the mast.

BRIEF DESCRIPTION OF THE DRAWINGS

Othe features and advantages of the invention will appear as the description proceeds when taken in connection with the accompanying drawings, in which.

DESCRIPTION OF THE ILLUSTRATED EMBODIMENTS

A sailboat in accordance with a first form of the invention, as illustrated in FIGS. 1–3 and 8, includes omnidirectional hull means in the form of a circular disclike hull, broadly indicated at 10. Hull 10 includes an outer skin or shell 11, formed of fiberglass or the like, with an inner filling or core of foamed material 12 to aid in flotation. The circular hull 10 is provided with a substantially flat upper deck and the lower outer portion is provided with curved surfaces to provide a disclike configuration.

The hull 10 does not have a predetermined bow and stern direction as in a conventional sailboat hull. However, the hull does have a forward portion which is located in the general direction of sailing, and an aft portion located behind the forward portion. For purposes of orientation and to aid in a better understanding of this invention, a dash-dot line 14 is shown in FIG. 1 indicating an axis extending generally in the fore and aft directions and through the center of the circular hull 10.

Figure 1:
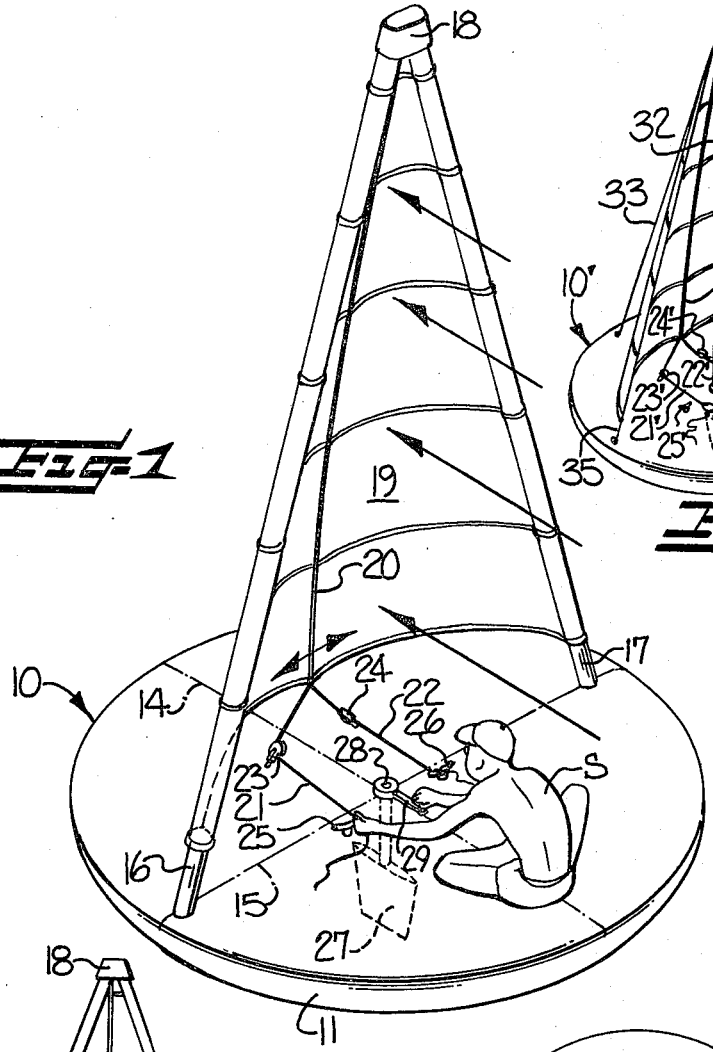
FIG. 1 is an isometric view of one embodiment of a sailboat in accordance with the present invention.

A dash-dot line 15 is also shown in FIG. 1 extending perpendicularly to the fore-aft axis line 14 and also passing through the center of the hull. The line 15 generally defines a port-starboard axis on the hull. The forward portion of the hull is located forward of the port-starboard axis 15, while the aft portion of the hull is located behind this axis. As illustrated, a sailor S is seated in the aft portion of the hull.

Figure 2:
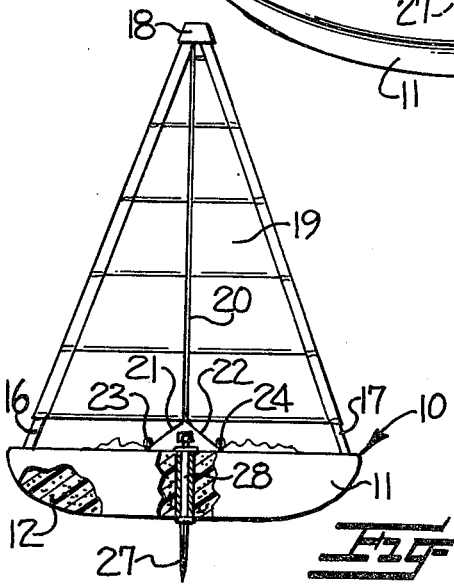
FIG. 2 is an elevational view of the sailboat looking from the aft position and with portions of the hull being shown in section.

Sail support means is provided on the hull 10 and includes a pair of masts 16, 17 having their lower ends anchored to the hull and extending upwardly therefrom. As illustrated, the lower ends of the masts 16, 17 are located on the port-starboard axis 15 and generally adjacent opposite ends of this axis. The masts 16, 17 extend upwardly from the hull in converging relation to each other with suitable means being provided for connecting together the upper ends of the masts. As illustrated in FIGS. 1 and 2, a cap member 18 is provided to connect together the upper ends of the masts 16, 17.

A generally triangular sail, broadly indicated at 19, is suitably connected along two adjacent side edges to the masts 16, 17, with the third side edge of the triangular sail terminating above the level of the upper deck of the hull 10 and extending unsupported in a generally horizontal direction between the masts. To aid in controlling the direction of movement of the sailboat and to make the most efficient use of the sail 19, the transverse dimension of the sail 19 is greater than the horizontal distance between the masts 16, 17 at the same vertical location to thereby permit billowing of the sail 19 by the wind. As illustrated, the sail includes an elongate stiffening member or batten 20 which is located in the medial portion of the sail and extends longitudinally between the two supported side edges and intersecting the unsupported third side edge of the sail. Sail control means, in the form of a pair of control lines 21, 22, is operatively connected to the unsupported third side edge of the sail at the stiffening member or batten 20. The control lines 21, 22 pass through respective guide pulleys 23, 24 located on the hull 10 with the free ends of the control lines 21, 22 extending generally rearwardly so as to be accessible by the sailor S on the boat. Suitable anchoring means, in the form of cleats 25, 26, are provided on the upper deck of the hull 10 so that the control lines 21, 22 may be temporarily secured in a desired adjusted position. The control lines 21, 22 pull the sail laterally in the port or starboard direction and thus serve to alter the configuration of the sail to enable the sailor to shape the sail into a desired hydrodynamic airfoil shape for control over the direction and speed of sailing.

The sailboat also includes a centerboard 27 positioned beneath the hull and mounted for pivotal movement about a substantially vertical axis located in the center of the circular disclike hull. The centerboard 27 includes a shaft 28 which extends axially upwardly through the hull to the upper surface thereof. A centerboard control in the form of a lever 29 is connected to the upper end of the shaft 28 and is accessible by the sailor S to enable him to adjust the pivotal position of the centerboard 27 with respect to the hull to thereby assist in controlling the direction of movement of the vessel. It will be appreciated that the heading which the sailboat takes will correspond generally to the direction of the centerboard 27.

Figure 4:
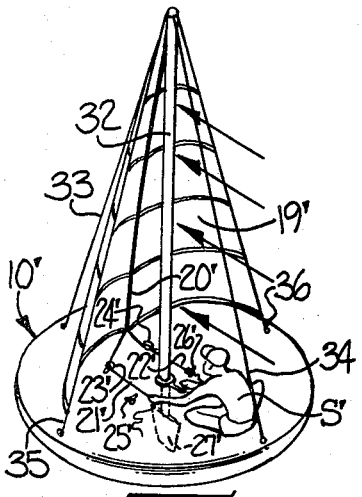
FIG. 4 is a modified form of a sailboat illustrating the sail being supported from shrouds extending from a single central mast to the hull.
Figure 3:
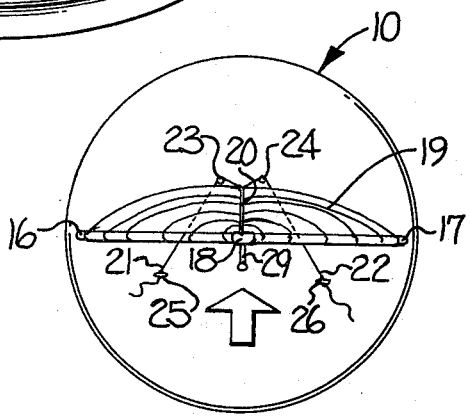
FIG. 3 is a plan view of the sailboat shown in FIG. 1.

The modified embodiment of the sailboat illustrated in FIG. 4 is similar in many respects to that of FIG. 1 and to avoid repetitive description, elements in the FIG. 4 embodiment which correspond to elements previously described in connection with FIGS. 1–3 will bear the same reference characters, with prime notation added. Referring more particularly to FIG. 4, it will be seen that this modified form of the invention differs over that of the previous embodiment essentially in the way in which the sail is supported. More particularly, as shown in FIG. 4 there is provided a single mast 32 which is anchored at its lower end in the center of the hull 10′ and extends vertically upwardly therefrom. The sail is supported in its upright position by fore and aft stays 33, 34, respectively, and by port and starboard shrouds 35, 36 respectively. The side edges of the triangular sail 19′ are connected to and supported by the shrouds 35, 36 by suitable means, such as by the type of clips which are conventionally used for securing a jib sail to the forestay of a conventional sloop-rigged sailboat.

Figure 5:
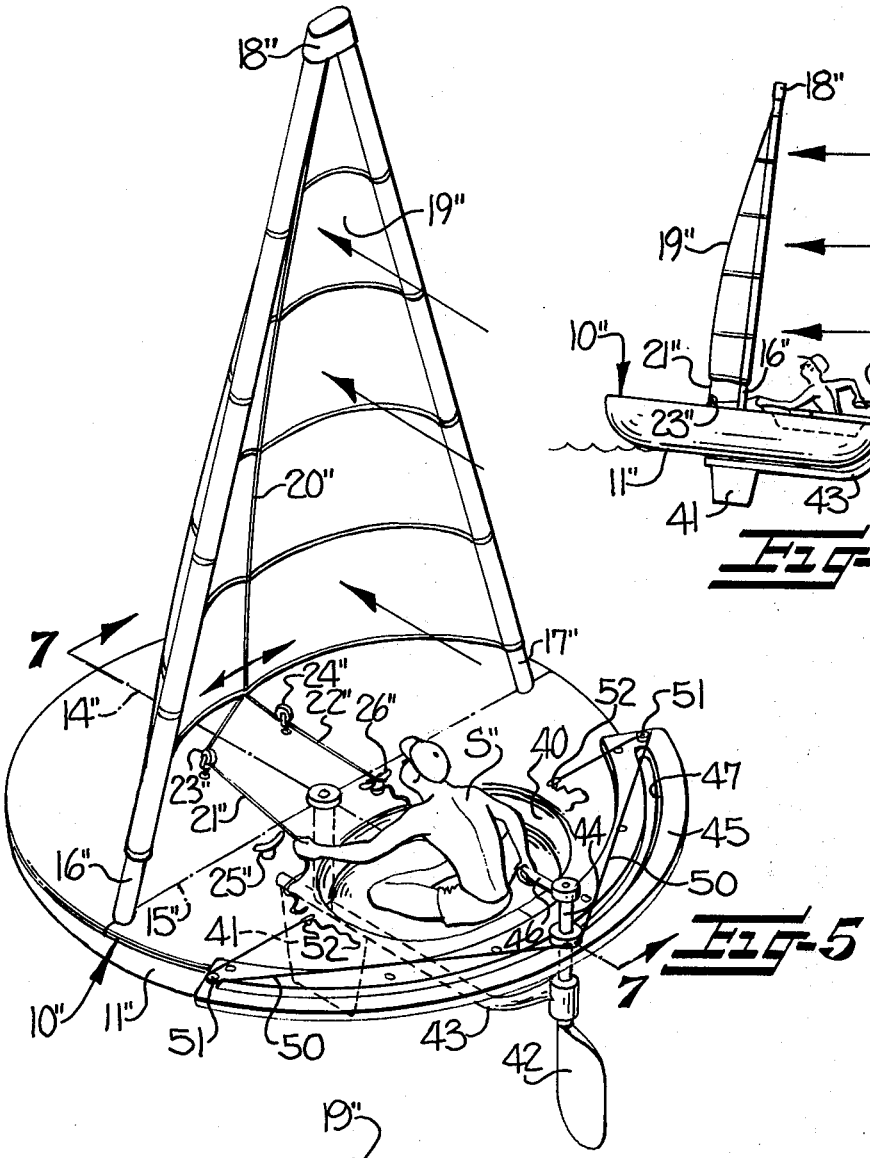
FIG. 5 is a view similar to FIG. 1 but showing another modified form of a sailboat in accordance with this invention.
Figure 6:
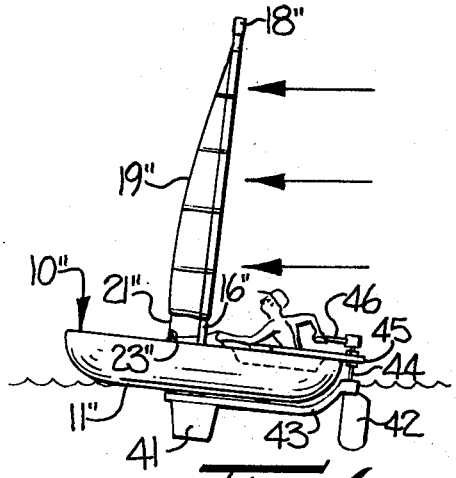
FIG. 6 is a side elevational view of the sailboat shown in FIG. 5 and illustrating the manner in which the sailboat is propelled along the water by the wind.
Figure 7:
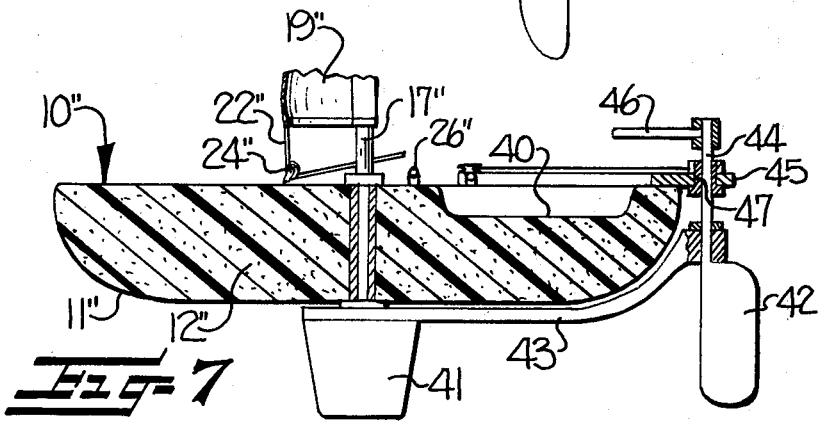
FIG. 7 is a fragmentary vertical sectional view taken substantially along the line 7—7 in FIG. 5.

The sailboat illustrated in FIGS. 5–7 is also quite similar to that previously described in connection with FIGS. 1–3, and to avoid repetition, elements which correspond to elements previously described in connection with FIGS. 1–3 will bear the same reference character with double prime notation added. As illustrated, the sailboat has a circular disclike hull 10″ which is somewhat larger than that in the previous embodiments. A depression 40 is formed in the upper deck of the hull 10″ to provide a seating area for the sailor and crew. A centerboard 41 is mounted beneath the hull for pivotal movement along a vertical axis extending generally upwardly through the center of the sailboat. A rudder 42 is also mounted beneath the hull of the sailboat generally in longitudinal alignment with the centerboard 41. An elongate supporting member 43 extends longitudinally from the centerboard 41 beneath the hull and to the aft portion of the hull for supporting the rudder 42 in the desired position. The rudder 42 has a shaft 44 which extends upwardly through the end portion of the support 43 and through a stationary arcuately shaped supporting bracket 45 mounted on the aft portion of the hull. A control lever or tiller 46 is mounted at the top of the shaft 44 and extends forwardly so as to be accessible by the sailor. The support bracket 45 has an elongate arcuate slot 47 therein, as best seen in FIG. 5, to thereby permit adjusting the position of the rudder 42 circumferentially around the aft portion of the hull. As the rudder 42 is moved circumferentially, the centerboard 41 is pivoted about its axis to maintain longitudinal alignment with the rudder 42. The position of the centerboard 41 and rudder 42 may thus be adjusted as a unit with respect to the hull to adjust the heading of the boat and the trim of the sail with respect to the wind. A pair of control lines 50 extend from the rudder 42 and around pulleys 51 to facilitate adjusting the position of the rudder. The control lines 50 are anchored in cleats 52. The rudder 42 is also mounted for pivotal movement about the axis of shaft 44. If desired, the rudder 42 can be maintained in a fixed position in the arcuate slot 47 and can be pivoted about the axis of shaft 44 to enable the sailboat to be sailed in a manner similar to the conventional system.

Figure 8:
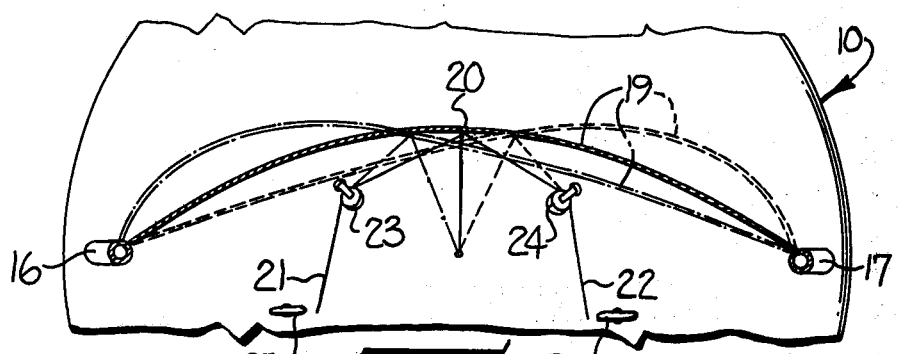
FIG. 8 is a somewhat schematic fragmentary horizontal sectional view through the lower portion of the sail in the sailboat of FIG. 1 and illustrating the manner in which the batten may be moved between the dotted line port and starboard positions to control the configuration of the sail.

The control means for the sail and the manner in which the shape of the sail can be altered is best understood from FIG. 8. As illustrated, the batten 20 can be moved laterally in the port or starboard direction by the control lines 21, 22 to cause one side of the sail to be stretched tight while allowing the other side to billow, as illustrated in the broken lines. When the line 21 is pulled tight and the line 22 is relaxed, the batten 20 is displaced to the port side and the sail assumes the shape generally indicated by the dot-dash lines with the port half of the sail being allowed to billow while the starboard half of the sail is maintained tight and substantially straight to form the desired airfoil configuration. On the other hand, when the line 22 is pulled tight and the line 21 is relaxed, the batten 20 is displaced to the starboard side, and the sail assumes the shape indicated by the dashed lines, with the starboard side of the sail billowing and the port side of the sail stretched tight. When both control lines are relaxed, the sail assumes a generally symmetrical configuration as indicated by the solid lines for sailing in a downward direction.

Figure 10:
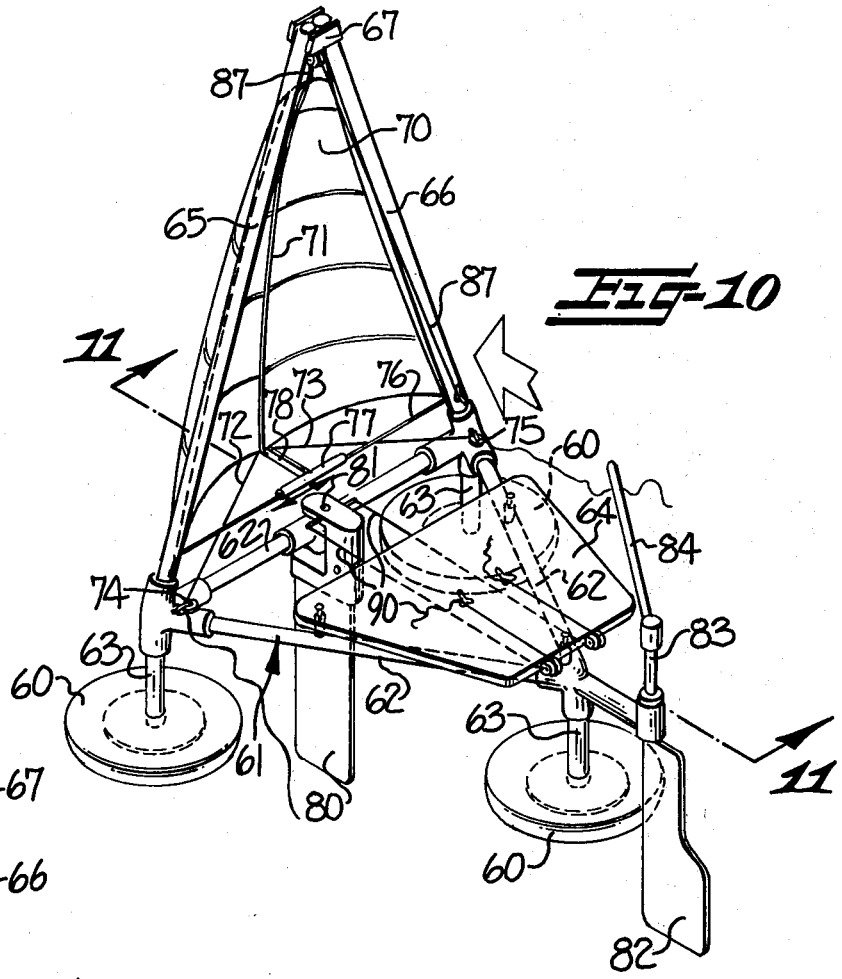
FIG. 10 is an isometric view of a multihull sailboat in accordance with the present invention.
Figure 11:
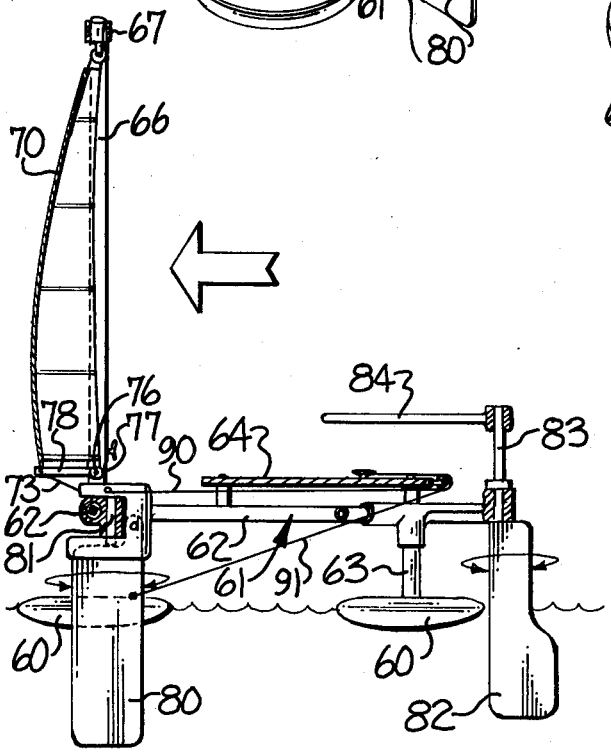
FIG. 11 is a vertical sectional view taken substantially along the line 11—11 in FIG. 10.

FIGS. 10 and 11 illustrate a multihull embodiment of a sailboat in accordance with this invention. As illustrated, the omnidirectional hull means comprises three separate buoyant hull members 60, each of a circular disclike configuration. The hull members 60 are connected together in a generally equilateral triangular relationship by a triangular frame, generally indicated at 61. Frame 61, more particularly, includes three side members 62 of substantially equal length, joined together at their opposite ends, and three upright members 63 at the three corners, which extend downwardly and are connected to the upper side of the respective individual hulls 60. A deck or platform 64 is provided on the upper side of the frame to provide a seating area for the sailor and one or more passengers. A pair of masts 65, 66 extend angularly upwardly from two adjacent corners of the frame, with the upper ends of the masts being joined together by a cap member 67. A generally triangular sail 70 having a longitudinally extending batten 71 is connected to shrouds extending alongside the masts 65, 66 and a halyard 87 is connected to the upper end of the sail for raising the sail along the shrouds. A pair of control lines 72, 73 are connected to the unsupported third side edge of the triangular sail at the batten 71 and pass through respective pulleys 74, 75 to enable the sailor to pull the sail laterally and alter the shape of the sail in the manner previously described. A supporting rod or wire 76 extends between the base of the masts 65, 66 and a sliding sleeve 77 is mounted thereon. Extending from the sleeve 77 is a sail support arm 78, which in turn is connected to the sail, with the control lines 72, 73 also being connected to the arm 78. This arrangement provides additional control and assistance in altering the shape of the sail.

The sailboat also includes a centerboard 80 which is mounted to the frame 61 and extends downwardly beneath the level of the individual hull members 60. The centerboard 80 is mounted for pivotal movement with respect to the frame about a substantially vertical pivotal axis 81. Control lines 90 are connected to the centerboard and extend rearwardly therefrom to permit adjustment of the pivotal position of the centerboard. The upper end of the centerboard 80 is also mounted for pivotal movement about a horizontal axis to permit raising the centerboard when desired. A cable or line 91 (FIG. 11) is provided for raising the centerboard. A rudder 82 is pivotally mounted to the aft portion of the frame 61, and includes an upwardly extending shaft 83, to which is connected a tiller 84. The tiller extends generally forwardly and is accessible by the sailor to enable him to pivotally adjust the rudder 82.

METHOD OF SAILING

Each embodiment of the sailboat is sailed in essentially the same manner. The method of sailing will be described as applied to the circular hull embodiment of the FIGS. 1–3, and in connection with the diagrammatic view shown in FIG. 9. With the wind moving from the top to the bottom of the page, as indicated by the arrows W, the sailboat, at the position indicated at A is sailing angularly into the wind, i.e. beating. The centerboard is pivoted sharply to port, almost along the port-starboard axis, and the direction of movement of the boat is along the dot-dash line. The batten is moved to the extreme port position so that the sail forms a desired airfoil configuration for propelling the boat angularly into the wind. The heading of the boat is off the forward port beam of the hull, as indicated by the arrow.

When the boat reaches the position indicated at B, it is sailing generally perpendicularly to the wind. The centerboard is pivoted slightly to port and forms a somewhat greater angle with respect to the port-starboard axis of the boat than in position A. For reference and comparison purposes, it will be understood that in all of the illustrated views, the sailor is seated at the same location on the hull and the arrow indicates the general heading of the boat with respect to the hull.

At the position indicated at C, the boat is sailing downwind and the centerboard has been pivoted so as to essentially lie along the fore-aft axis, being essentially perpendicular to the port-starboard axis. The control lines have been relaxed to allow the sail to form a generally symmetrical shape.

At position D, the sailboat is again sailing essentially perpendicularly to the wind but is preparing to head into the wind. The centerboard is now positioned angularly to the starboard and the heading of the boat is generally off the forward starboard beam. The batten has been shifted to the starboard to again shape the sail in the desired airfoil configuration.

At position E, the sailboat is again sailing angularly into the wind, i.e. beating, but on the opposite tack from that in position A. The centerboard is pivoted sharply to starboard and a very small angle with respect to the portstarboard axis.

To reverse direction, the boat makes a port circle as indicated in the succeeding positions F, G, and H, and then reaches a position I, which essentially corresponds to position A previously described.

Figure 9:
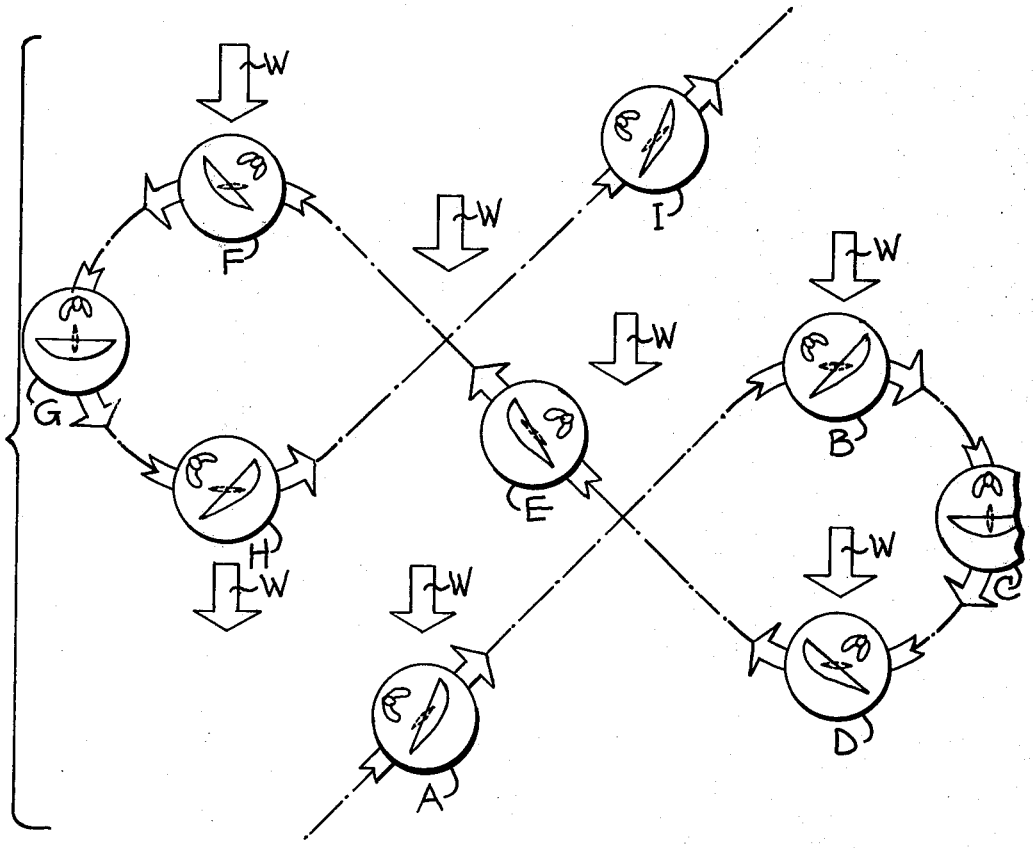
FIG. 9 is a somewhat schematic and diagrammatical view illustrating the manner in which the sailboat is sailed against the wind.

It will be noted that in all sailing positions illustrated in FIG. 9, the wind engages the same side of the sail, that is the side of the sail facing the aft direction. This method of sailing is in contrast to the conventional sailing method wherein the wind engages different sides of the sail when making a port tack and when making a starboard tack.

The sailboat of the present invention thus provides a novel sailing method and an interesting diversion from the normal sailing technique usually employed. This sailing system is quite easy to learn for a novice sailor, but is sufficiently challenging to retain the interest of more accomplished sailors.

In the drawings and specification there have been set forth preferred embodiments of the invention and although specific terms are employed, they are used in a generic and descriptive sense only and not for purposes of limitation.

What is claimed is:

1. A sailing vessel comprising the combination of:
(a) omnidirectional hull means,
(b) a sail,
(c) sail support means carried by said hull means and extending upwardly therefrom and cooperating with said sail for supporting two side edges thereof along intersecting angularly upwardly extending axes while leaving a third side edge of said sail unsupported and extending generally horizontally,
(d) sail control means connected to said third side edge of said sail medially of the adjacent corners of the sail and cooperating with said hull for pulling the sail laterally so as to alter the shape of the sail,
(e) a centerboard positioned beneath said hull and mounted for pivotal movement about a substantially vertical axis, and
(f) a centerboard control cooperating with said centerboard and positioned for operation by the sailor of said vessel for adjusting the pivotal position of said centerboard relative to said hull for assisting in controlling the direction of movement of said vessel.

2. A sailing vessel according to claim 1 wherein said sail includes an elongate stiffening member located between said two side edges of the sail and extending longitudinally and intersecting said third side edge of the sail, and wherein said sail control means is connected to said third side edge of the sail at said stiffening member.

3. A sailing vessel according to claim 1 wherein said sail support means includes a pair of masts with upper and lower ends, said lower ends being anchored on said hull means in laterally spaced relation with said upper ends being connected to one another, and wherein said two side edges of said sail are connected respectively to said pair of masts.

4. A sailing vessel according to claim 1 wherein said sail support means includes a single mast with upper and lower ends, and a pair of shrouds extending from the upper end of said mast to laterally spaced apart locations on said hull means, and wherein said two side edges of said sail are connected respectively to said pair of shrouds.

5. A sailing vessel according to claim 1 wherein said hull means comprises a circular disc, and said centerboard is located at the center of the disc.

6. A sailing vessel according to claim 5 including a depression in the upper portion of said circular disc to provide a seating area for the sailor.

7. A sailing vessel according to claim 1 wherein said hull means is comprised of three separate buoyant hull members, frame means interconnecting said hull members, and means associated with said frame means and defining a deck for receiving one or more passengers thereon.

8. A sailing vessel comprising the combination of:
(a) a buoyant hull of a substantially circular disclike configuration,
(b) a generally triangular sail,
(c) sail support means carried by said hull and extending upwardly therefrom and cooperating with said generally triangular sail for supporting two side edges thereof along intersecting angularly upwardly extending axes while leaving the third side edge of said sail unsupported and extending generally horizontally,
(d) sail control means connected to said third side edge of said sail medially of the adjacent corners of the sail and cooperating with said hull for pulling the sail laterally so as to alter the shape of the sail,
(e) a centerboard positioned beneath said hull and mounted for pivotal movement about a substantially vertical axis located generally in the center of the circular disc-shaped hull, and
(f) a centerboard control cooperating with said centerboard and positioned for operation by the sailor of said vessel for adjusting the pivotal position of said centerboard relative to said hull for assisting in controlling the direction of movement of said vessel.

9. A sailing vessel according to claim 8 wherein said centerboard control comprises a control lever connected at one end to said centerboard and having a free end operable by the sailor for controlling the pivotal position of said centerboard.

10. A sailing vessel according to claim 8 additionally including a rudder positioned adjacent the circumferential edge of said circular hull and extending vertically beneath said hull for assisting in controlling the direction of movement of said vessel, and elongate mounting means connected to said centerboard and extending generally horizontally therefrom beneath said hull to the circumferential edge of said hull for mounting said rudder.

11. A sailing vessel according to claim 10 wherein said elongate mounting means cooperates with said rudder for mounting the rudder for movement along the circumference of said hull simultaneously with the pivoting of said centerboard so as to maintain the rudder and centerboard in longitudinal alignment, and wherein said centerboard control comprises a control lever connected at one end to said elongate mounting means for said rudder and having a free end positioned for operation by the sailor of said vessel for controlling the position of said centerboard and said rudder.

12. A sailing vessel according to claim 11 wherein said rudder is also mounted for pivotal movement with respect to said elongate mounting means so as to be movable out of longitudinal alignment with said centerboard.

13. A sailing vessel comprising the combination of:
(a) three buoyant hull members of circular disclike configuration,
(b) frame means connected to the upper sides of said hull members and extending upwardly therefrom for rigidly interconnecting said hull members,
(c) means associated with said frame means and defining a deck for receiving one or more passengers thereon,
(d) a generally triangular sail,
(e) sail support means carried by said frame means and extending upwardly therefrom and cooperating with said generally triangular sail for supporting two side edges thereof along intersecting angularly upwardly extending axes while leaving the third side of the sail unsupported and extending generally horizontally,
(f) sail control means connected to said third side edge of said sail medially of the adjacent corners of the sail and cooperating with said sail for pulling the sail laterally so as to alter the shape of the sail,
(g) a centerboard extending vertically and beyond said hull members and mounted for pivotal movement about a substantially vertical axis, and
(h) a centerboard control cooperating with said centerboard and positioned for operation by the sailor of said vessel for adjusting the pivotal position of said centerboard relative to hull members for assisting in controlling the direction of movement of said vessel.

* * * * *